US005533744A

United States Patent [19]

Boehm et al.

[11] Patent Number: 5,533,744

[45] Date of Patent: Jul. 9, 1996

[54] SKI BRAKE SPUR

[75] Inventors: Alfred Boehm, Polling; Werner Messerschmidt, Garmisch-Partenkirchen; Gerhard Sedlmair, Farchant, all of Germany

[73] Assignee: Marker Deutschland GmbH, Germany

[21] Appl. No.: 281,222

[22] Filed: Jul. 27, 1994

[30] Foreign Application Priority Data

Jul. 27, 1993 [DE] Germany ..... 43 25 175.7

[51] Int. Cl.[6] ..... A63C 7/10

[52] U.S. Cl. ..... 280/605; 280/604

[58] Field of Search ..... 280/604, 605, 280/28.11

[56] References Cited

U.S. PATENT DOCUMENTS

| | | | |
|---|---|---|---|
| 2,195,136 | 3/1940 | Simonsen et al. | 280/605 |
| 4,230,337 | 10/1980 | Storandt | 280/605 |
| 4,234,206 | 11/1980 | Hofbauer et al. | 280/605 |
| 4,252,337 | 2/1981 | Luithlen | 280/605 |
| 4,266,804 | 5/1981 | Murata | 280/605 |
| 4,350,365 | 9/1982 | DeVigili et al. | 280/605 |
| 4,763,918 | 8/1988 | Sedlmair | 280/605 |

FOREIGN PATENT DOCUMENTS

| | | | |
|---|---|---|---|
| 144403 | 8/1935 | Austria | 280/605 |
| 146209 | 2/1936 | Austria | 280/605 |
| 0117822A3 | 6/1985 | European Pat. Off. . | |
| 546292 | 10/1993 | European Pat. Off. . | |
| 2305206 | 11/1976 | France | 280/605 |
| 2526321 | 11/1983 | France . | |
| 2560524A1 | 9/1985 | France . | |
| G7527776 | 1/1976 | Germany . | |
| 2531995 | 2/1976 | Germany . | |
| 2619673 | 11/1977 | Germany . | |
| 2756895A1 | 8/1978 | Germany . | |
| 2833259 | 3/1979 | Germany . | |
| 2757308A1 | 7/1979 | Germany . | |
| 3309295 | 9/1984 | Germany | 280/604 |
| 3048175 | 4/1985 | Germany . | |
| 2906477 | 2/1991 | Germany . | |
| 407836 | 9/1966 | Switzerland | 280/604 |
| 1662340 | 7/1991 | U.S.S.R. . | |

OTHER PUBLICATIONS

"Sportartikel Zeitung"(SAZ), No. 1, Jan. 18, 1982, p. 19.

Brochure: Valluga–trend setting in construction and safety of the Company Meyer Patent Evalution–GmbH, oberasbach, distributed ISPO 84, Feb. 23, 1984.

*Primary Examiner*—Brian L. Johnson

*Attorney, Agent, or Firm*—D. Peter Hochberg; Mark Kusner; Michael Jaffe

[57] ABSTRACT

A brake spur for a ski brake arm, which at a free end possesses a transversely extending, plate-shaped extension. The plate-like extension makes an angle with the longitudinal axis of the brake spur and forms a gripping member with a brake edge. In order to enhance the manner of operation of the brake spur, a transversely extending shaped body is molded on the brake spur in front of the plate-like extension to provide an additional brake edge.

12 Claims, 2 Drawing Sheets

SKI BRAKE SPUR

FIELD OF THE INVENTION

The invention relates generally to a brake spur for a ski brake arm. More particularly, the present invention relates to a brake spur in the form of a molded covering or cap having a free end possessing a transversely extending, plate-like extension, which extends from a base surface of the brake spur at an angle to the longitudinal axis of the brake spur. The plate-like extension forms a gripping means with a brake edge.

German Patent Publication 2,531,995 A discloses a brake arm which is generally tubular in design. The brake arm includes a brake spur in the form of a transversely extending, plate-like extension, which aids in the braking action and comes to an end in a gripper or spade or the like. Such gripping means, which forms a brake edge, is intended to facilitate penetration of the brake arm into hard snow or ice.

For some time there has been an increased number of skis offered on the market, which have additional absorption plates adjacent to the binding. The absorption plates lead on the one hand to a greater distance between the ski binding and the ground and on the other hand to a greater weight of the ski. If in the case of such ski bindings conventional ski brakes arms are employed, there will be insufficient braking action. Conventional ski brake arms are not capable of functioning on all types of snow. Thus, a ski brake arm of the type initially mentioned as disclosed in the said German Patent Publication 2,531,995 A is advantageous on a hard, iced snow surface, but not on soft or powdered snow.

SUMMARY OF THE INVENTION

One object of the present invention is to provide a ski brake spur that when skiing with a comparatively great weight and a large clearance from the ground surface, will yield an efficient braking action on various different types of snow, without entailing any additional component or, respectively, any substantial increase in the size of the ski brake arm or spur.

The foregoing object is attained by the present invention by providing a brake spur having at least one transversely extending shaped body integrated or formed with the base surface of the brake spur in front of the plate-like extension, to constitute an additional brake edge. One effect of such at least one additional brake edge is to increase the braking efficiency on comparatively hard snow because a further hook-like projection is formed. In the case of soft deep snow, this design of the brake spur has the advantage that the at least one transversely extending shaped body serves as an additional displacing or compacting body, in front of whose additional brake edge the snow will pile up so that the entire ski will tend to "float" or glide on the snow surface. Accordingly, even in the case of a comparatively high weight, sinking of the ski into the deep snow should be prevented. The at least one transversely-extending shaped body preferably has a cross section in the form of a right-angled triangle.

It is an advantage if several transversely-extending shaped bodies are arranged one after the other, which have different heights so that brake edges are formed, which are at different distances from the base surface of the brake spur. In this respect, starting from the plate-like extension which comprises the first brake edge, the distance between the brake edges and the base surface of the brake spur may continuously decrease as the distance from the free end increases.

This stepped arrangement provides for additionally increased braking action of the brake edges arranged one behind the other. Braking action is also increased by having different distances between each brake edge. In this respect, the distance between each brake edge increases as the distance from the free end decreases. The increased distance between brake edges allows more piling space for snow. This is particularly helpful for braking in deep snow.

A particularly advantageous design has been found to be one in which the exterior angle between the plate-like extension and the longitudinal axis of the brake spur is equal to approximately 40° to 60°, and more especially 45° to 55°. Adopting such angle allows the brake edge of the plate-like extension to be particularly effectively utilized. Between the plate-like extension and the base surface of the brake spur, it is possible to provide a limiting wall so that at the free end of the brake spur there is a claw-like configuration which is closed on one side and is open on the opposite side.

In a preferred embodiment of the present invention the brake spur is formed of injection molded synthetic resin and is connectable at the end opposite the free end to a brake arm comprised of metal wire or metal tubing. It is in this manner that the desired design of the brake spur can be extremely simple and inexpensively produced. The use of metal wire or metal tube means for the brake arm provides increased strength of the brake arm.

In an alternative embodiment of the present invention the at least one transversely-extending shaped body is configured such that in cross section it has the form of a right-angled triangle, whose hypotenuse is a radius. A groove-like surface results so that the at least one transversely-extending shaped body has the configuration of a comparatively pointed or sharp tooth.

In yet another alternative embodiment of the present invention the at least one additional brake edge is arcuate rather than linear.

Further advantageous developments and convenient forms of the invention will be understood from the following detailed description of embodiments thereof, in conjunction with the accompanying drawings.

DETAILED DESCRIPTION OF THE INVENTION

Figure 1:
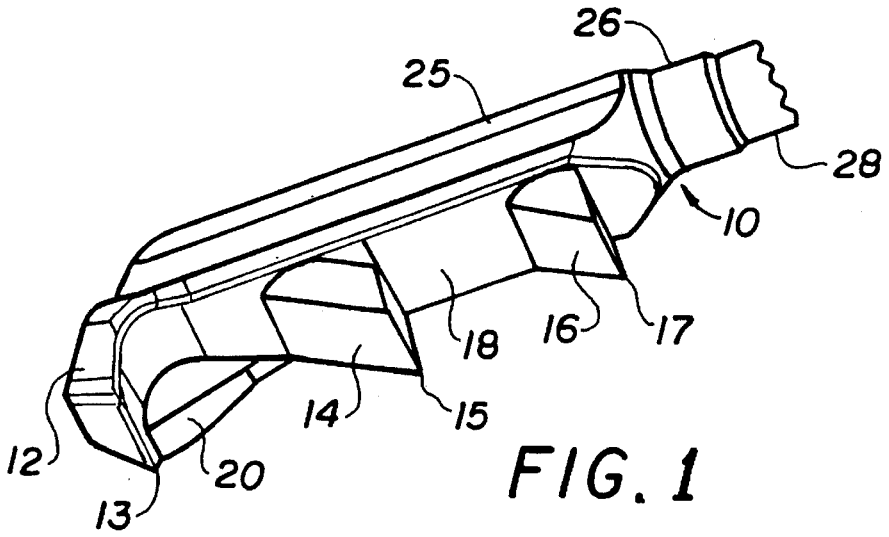
FIG. 1 is a perspective view of the brake spur in accordance with a preferred embodiment of the invention.

The brake spur 10 depicted in FIGS. 1 through 6 is a molded covering or cap comprised of injection molded synthetic resin and which is slipped on a brake arm 28 comprised of wire or tubing, in such a manner that it is firmly mounted thereon. Referring now to FIGS. 1–4, brake spur 10 is comprised of a base portion having a lower surface in the form of a flat base surface 18. At its free end, brake spur 10 has a transversely extending, plate-like extension 12, which extends outwardly from base surface 18 and is set in the present embodiment at an exterior angle ∝ of 53° to longitudinal axis 25 of brake spur 10. Plate-like extension 12 is integrated with base surface 18 and forms a gripping means having a brake edge 13. A connecting or attachment means 26 is integrated with base surface 18 at the end of brake spur 10 opposite plate-like extension 12.

Transversely extending shaped bodies 14 and 16 are molded, formed or integrated with base surface 18. Bodies 14 and 16 in cross section have the configuration of a right-angled triangle. Accordingly, shaped bodies 14 and 16 provide brake edges 15 and 17. Shaped bodies 14 and 16 are each comprised of two surfaces. The first surface slopes at a small angle toward the free end of brake spur 10, whereas the second surface is directed at a steep angle and toward base surface 18. Preferably, the second surface forms a right angle with base surface 18, as shown in FIG. 2.

The vertical distance from base surface 18 to brake edges 13, 15 and 17 continuously decreases as the distance from the free end of brake spur 10 increases. Furthermore, the horizontal distance along base surface 18 between brake edges 13, 15 and 17 continuously increases as the distance from the free end of brake spur 10 decreases. Accordingly, brake edges 13, 15 and 17 comprise hooks which are staggered in distance and height, and are arranged one after the other. This configuration increases the braking action of the braking spur and also piles up the snow to enable the ski to glide on the snow surface so that the ski will not sink into the snow.

Figure 2:
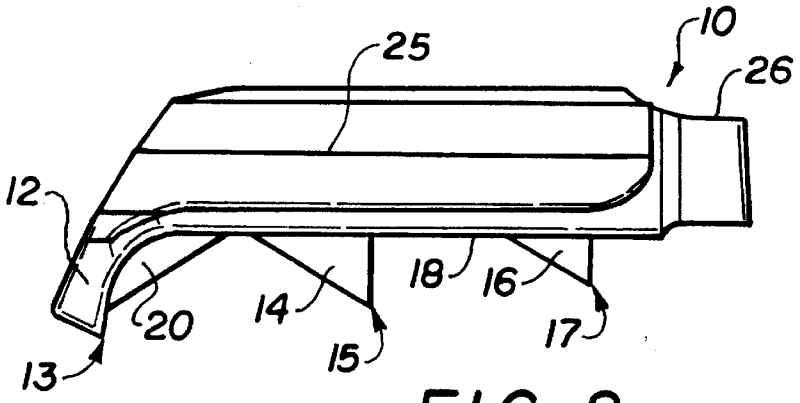
FIG. 2 is a side view of the brake spur in accordance with FIG. 1.
Figure 3:
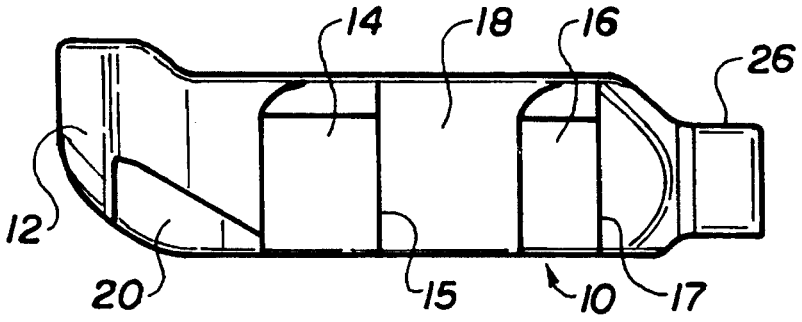
FIG. 3 is a bottom plan view of the brake spur taken along in accordance with FIG. 1.
Figure 4:
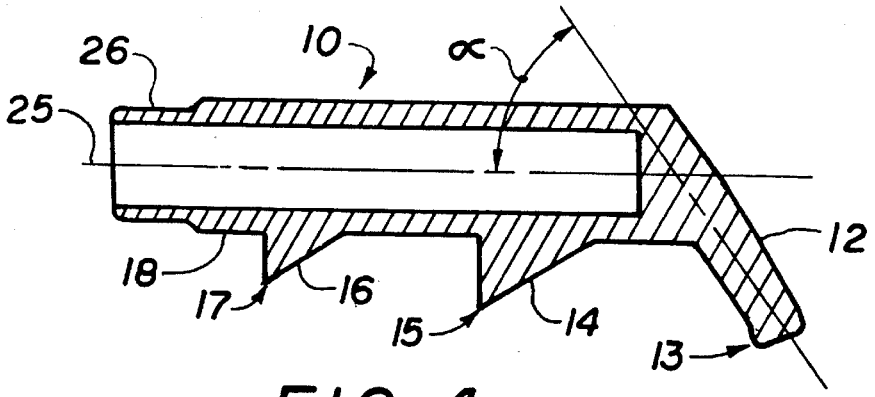
FIG. 4 is a longitudinal section view of the brake spur in accordance with FIG. 1.

Between plate-shaped extension 12 and base surface 18 of brake spur 10 a longitudinally extending limiting wall 20 is provided to the side, as shown in FIGS. 1, 2 and 3. Accordingly, the free end of brake spur 10 forms a claw-like configuration or gripping means closed on one side.

Figure 5:
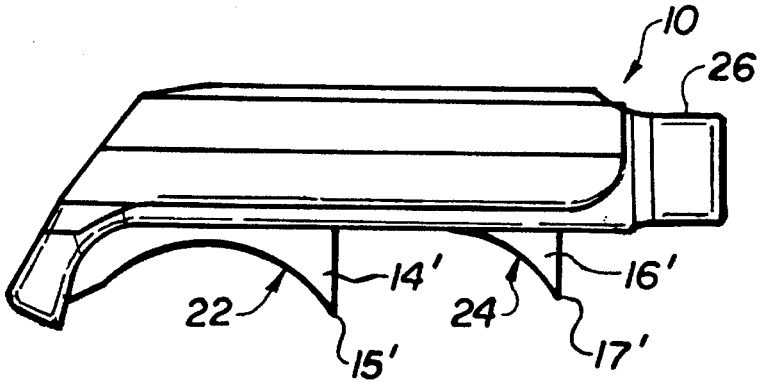
FIG. 5 is a side view of an alternative embodiment of the present invention.

Referring now to FIG. 5, an alternative embodiment of brake spur 10 is shown having shaped bodies 14' and 16', which are essentially the same as shaped bodies 14 and 16 shown in FIGS. 1 through 4. However, shaped bodies 14' and 16' possess groove-like surfaces 22 and 24 so that the hooks formed by brake edges 15' and 17' are sharp-edged.

Figure 6:
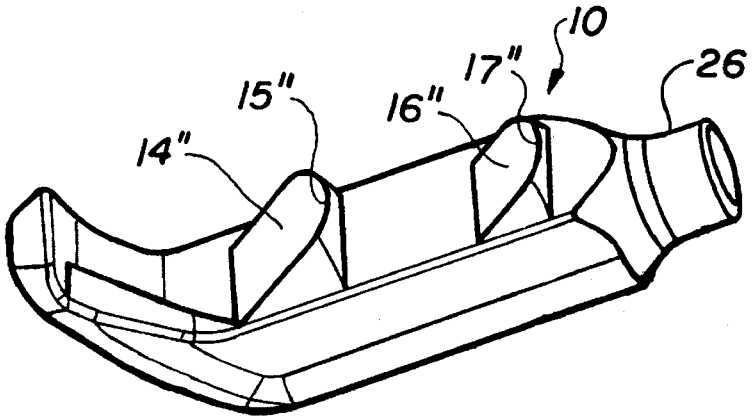
FIG. 6 is a perspective view of a further alternative embodiment of the present invention.

A further alternative embodiment of brake spur 10 is illustrated in FIG. 6. In this embodiment one of the two surfaces comprising shaped bodies 14" and 16" is arcuate or curved to increase the braking action of the brake spur. In particular, brake edges 15" and 17" are in the form of an arcuate or curved edge.

With the brake spur as explained above and which is connectable to a brake arm formed of metal wire or tubing, it is possible to modify existing brake arms which are already mounted and to improve the braking action thereof.

The present invention has been described with particular emphasis to the preferred embodiments thereof, but variations and modifications may occur to those skilled in the art to which the invention pertains from the specification, drawings and the appended claims.

What is claimed is:

1. A brake spur for improving the braking action of a ski brake arm, said brake spur having a longitudinal axis and comprising:

a base portion having a free end and an attachment end, said attachment end comprising a connecting means for connecting said brake spur to said brake arm;

gripping means integrally attached to the free end of said base portion, and extending in a direction transverse to the longitudinal axis of said brake spur, said gripping means including a first brake edge; and a plurality of shaped body portions integrated with a surface of said base portion between said free end and said attachment end, and extending in a direction transverse to the longitudinal axis of said brake spur, wherein each said shaped body portion includes a first surface sloping towards said base portion and a second surface at a right angle to said base portion and forming an intersection with said first surface, said intersection defining a second brake edge, wherein said plurality of shaped body portions are arranged longitudinally between the free end and the attachment end, each of the second brake edges of the shaped body portions arranged one behind the other and having decreasing distances from the surface of the base portion as the distance of the respective shaped body portions from the gripping means increases; and longitudinally extending limiting wall between said gripping means and the surface of the base portion.

2. A brake spur as defined in claim 1, wherein the gripping means transversely extends at an exterior angle of approximately 40° to 60° from the longitudinal axis of the brake spur.

3. A brake spur as defined in claim 1, wherein said brake spur is comprised of injection molded synthetic resin.

4. A brake spur as defined in claim 1, wherein the first surface is curved.

5. A brake spur as defined in claim 1, wherein said second brake edge has an arcuate shape.

6. A brake spur as defined in claim 1, wherein the distance between each of the brake edges of the shaped body portions increases as the distance of the respective shaped body portions from the gripping means decreases.

7. A brake spur for improving the braking action of a ski brake arm, said brake spur having a longitudinal axis and comprising:

a base portion having a free end and an attachment end, said attachment end comprising a connecting means for connecting said brake spur to said brake arm;

gripping means integrally attached to the free end of said base portion, and extending in a direction transverse to the longitudinal axis of said brake spur, said gripping means including a first brake edge;

at least one shaped body portion integrated with a surface of said base portion between said free end and said attachment end, and extending in a direction transverse to the longitudinal axis of said brake spur, wherein said shaped body portion includes a first surface sloping towards said base portion and a second surface at a right angle to said base portion and forming an intersection with said first surface, said intersection defining a second brake edge; and a longitudinally extending limiting wall between said gripping means and the surface of the base portion.

8. A brake spur as defined in claim 7, wherein said limiting wall is disposed on one side of the surface of the base portion and of the gripping means.

9. A brake spur as defined in claim 7, wherein the gripping means transversely extends at an exterior angle of approximately 40° to 60° from the longitudinal axis of the brake spur.

10. A brake spur as defined in claim 7, wherein said brake spur is comprised of injection molded synthetic resin.

11. A brake spur as defined in claim 7, wherein the first surface is curved.

12. A brake spur as defined in claim 7, wherein said second brake edge has an arcuate shape.

* * * * *